US011135636B2

(12) United States Patent
Titcomb et al.

(10) Patent No.: US 11,135,636 B2
(45) Date of Patent: Oct. 5, 2021

(54) TIE ROD FOR CONCRETE FORMING SYSTEM AND RELATED METHOD OF MAKING

(71) Applicant: Titcomb Brothers Manufacturing, Inc., Westport, MA (US)

(72) Inventors: Ted Titcomb, East Sandwich, MA (US); Paul S. Titcomb, Marion, MA (US)

(73) Assignee: Titcomb Brothers Manufacturing, Inc., Westport, MA (US)

( * ) Notice: Subject to any disclaimer, the term of this patent is extended or adjusted under 35 U.S.C. 154(b) by 224 days.

(21) Appl. No.: 15/972,749

(22) Filed: May 7, 2018

(65) Prior Publication Data

US 2018/0318904 A1 Nov. 8, 2018

Related U.S. Application Data

(60) Provisional application No. 62/502,066, filed on May 5, 2017.

(51) Int. Cl.

| | |
|---|---|
| ***B21D 35/00*** | (2006.01) |
| ***B21K 1/24*** | (2006.01) |
| ***E04G 11/10*** | (2006.01) |
| ***E04G 17/04*** | (2006.01) |
| ***B21D 53/84*** | (2006.01) |
| ***B21F 45/00*** | (2006.01) |
| ***E04G 17/075*** | (2006.01) |
| ***B21K 1/54*** | (2006.01) |

(52) U.S. Cl.

CPC ..... *B21D 35/001* (2013.01); *B21D 53/84* (2013.01); *B21K 1/54* (2013.01); *E04G 11/10* (2013.01); *E04G 17/047* (2013.01); *B21F 45/00* (2013.01); *E04G 17/0754* (2013.01)

(58) Field of Classification Search

CPC ..... B21F 11/00; B21F 45/00; B21D 35/84; B21D 35/001; B21D 53/84; E04G 17/047; E04G 17/0754; E04G 11/10; B21K 1/54

USPC ..... 72/331

See application file for complete search history.

(56) References Cited

U.S. PATENT DOCUMENTS 2,920,371 A * 1/1960 Shoemaker ..... E04G 17/0754 249/214
3,010,175 A * 11/1961 Shoemaker ..... E04G 17/0721 249/41
3,746,297 A * 7/1973 Daniels, Jr. ..... E04G 17/0754 249/40

(Continued)

OTHER PUBLICATIONS

What is Punching, retrieved date Oct. 26, 2020.*
Punch process definition, retrieved date Oct. 26, 2020.*
Die, retrieved date Oct. 26, 2020.*

*Primary Examiner* — Adam J Eiseman
*Assistant Examiner* — Mohammed S. Alawadi
(74) *Attorney, Agent, or Firm* — Nelson Mullins Riley & Scarborough LLP; Anthony A. Laurentano

(57) ABSTRACT

A method of forming one or more tie rods that includes flattening a main body of a wire in a first selected plane to form a flattened main body, further flattening selected portions of the flattened main body in a second plane perpendicular to the first plane to form one or more break back regions, and then passing the wire through a punch press machine to form one or more coined regions in one or more ends of the wire, thus forming the tie rod.

8 Claims, 8 Drawing Sheets

(56) References Cited

U.S. PATENT DOCUMENTS

| | | | | | |
|---|---|---|---|---|---|
| 4,571,968 | A * | 2/1986 | Kanno | B23D 17/06 | 72/331 |
| 5,215,830 | A * | 6/1993 | Cinti | E04C 5/012 | 428/606 |
| 5,255,488 | A * | 10/1993 | Johnson | E04G 17/0754 | 249/216 |
| 5,582,388 | A * | 12/1996 | Baxter | E04G 17/00 | 249/213 |
| 5,987,830 | A * | 11/1999 | Worley | E04B 1/41 | 249/190 |
| 2004/0011943 | A1* | 1/2004 | Long, Sr. | E04G 17/06 | 249/216 |
| 2013/0269572 | A1* | 10/2013 | Lambrechts | E04C 5/012 | 106/638 |

* cited by examiner

TIE ROD FOR CONCRETE FORMING SYSTEM AND RELATED METHOD OF MAKING

RELATED APPLICATION

The present application is claims priority to U.S. provisional patent application Ser. No. 62/502,066, filed on May 5, 2017, and entitled Tie Rod For Concrete Forming System, the contents of which are herein incorporated by reference.

FIELD OF THE INVENTION

The present invention is related to the fabrication of concrete walls, such as for home foundations, using suitable concrete forms, and particularly to a tie rod for use in connection with the concrete forms for forming the concrete walls.

BACKGROUND OF THE INVENTION

Conventional concrete walls may be created by pouring concrete into a suitable concrete form. As is known in the art, concrete foundation walls are generally poured between two sets of concrete forms disposed in essentially parallel relationship and defining therebetween a channel having a dimension for the desired thickness of the concrete wall. Such opposed, spaced apart walls are generally held in a fixed relationship relative to each other against the immense weight of any poured concrete by tie rods and turnbuckle assemblies having abutment surfaces against which a locking or latching arm is mounted on an adjacent form section. Once assembled into the shape of the wall, wet concrete is poured into the channel formed between the concrete forms and allowed to cure. The concrete forms typically comprise multiple form panels, which may for example be formed of wood or any other suitable well known material. The height of the form panel may vary by application.

Multiple form panels may be placed side-by-side in order to construct a wall of a desired length. Because the wet poured concrete takes the shape of the forms in which it is placed, the finished concrete wall corresponds in configuration to the assembled form. Therefore, it is important to align precisely the panels composing the concrete form in order to ensure that the finished wall has the desired appearance and strength. The panels can also have mounted thereto on the exterior surface one or more panel bars that extend horizontally across the panel. The panel bars may be, for example, metal bars about two inches wide that are affixed to the form panel. If multiple panel bars are provided on a single panel, they may be spaced at predetermined locations along the height of the form panel. The panel bar may include a latch or lever that allows the panels to be clipped together side-by-side, as well as a plurality of shoulder bolts. If needed, a turnbuckle can be mounted to the panel bar in the vicinity of the shoulder bolts, with for example, the shoulder bolt positioned to the left of the turnbuckle and the latch on the right of the turnbuckle. The turnbuckle may contact the shoulder bolt in order to hold the turnbuckle in place.

The concrete forming systems can also employ tie-rods that are disposed between aligned panels in order to keep the panels properly spaced apart and to ensure that the panels are coupled to each other in a secure manner. The tie rods extend through openings formed in the spaced apart form sections or panels and hold the sections against relative movement toward each other. The tie-rods may extend outwardly of the sections by a selected amount as is known in the art. The portion of the tie-rods that extend beyond the panel forms typically include a flattened or coined section that is adapted to engage with the latch that is coupled to the panel bar. Once the concrete is poured between the panel forms and allowed to cure, the portion of the tie rods that extend beyond the concrete walls can be snapped off.

A problem with prior art tie rods is that they can be relatively difficult to position relative to the form panels. Further, the portion of the tie rods that extend beyond the formed and cured concrete wall can be difficult to remove, or when snapped off, typically do not break off cleanly from the rest of the tie rod.

SUMMARY OF THE INVENTION

The present invention is directed to a method of forming a tie rod, comprising flattening a main body of a wire formed of a selected material in a first selected plane to form a flattened main body, further flattening selected portions of the flattened main body in a second plane perpendicular to the first plane to form one or more break back regions, and then passing the wire through a punch press machine to form one or more coined regions in one or more ends of the wire, thus forming the tie rod.

The punch press machine includes a first die having a first protrusion extending outwardly therefrom and a second opposed die having a second protrusion extending outwardly therefrom, wherein the first and second protrusions are offset in a direction of wire travel relative to each other. Further, the dies are moved towards each other to press the wire traveling therethrough to form the coined regions and to separate the main body of the wire into first and second adjacent tie rods.

The step of moving further comprises pressing the dies into and out of contact with each other under a selected amount of pressure. The step of pressing further comprises forming a first coined region facing in a first direction in a first end of the first tie rod, and forming a second coined region facing in a second direction in a second end of the second tie rod, wherein the first and second directions are opposed relative to each other, and wherein the first end of the first tie rod and the second end of the second tie rod are adjacent to each other during formation.

Exemplary embodiments described herein address these and other problems associated with positioning and aligning concrete forms.

The exemplary embodiments will now be described in detail with reference to the attached drawings.

BRIEF DESCRIPTION OF THE DRAWINGS

These and other features and advantages of the present invention will be more fully understood by reference to the following detailed description in conjunction with the attached drawings in which like reference numerals refer to like elements throughout the different views. The drawings illustrate principals of the invention and, although not to scale, show relative dimensions.

DETAILED DESCRIPTION

Figure 1:
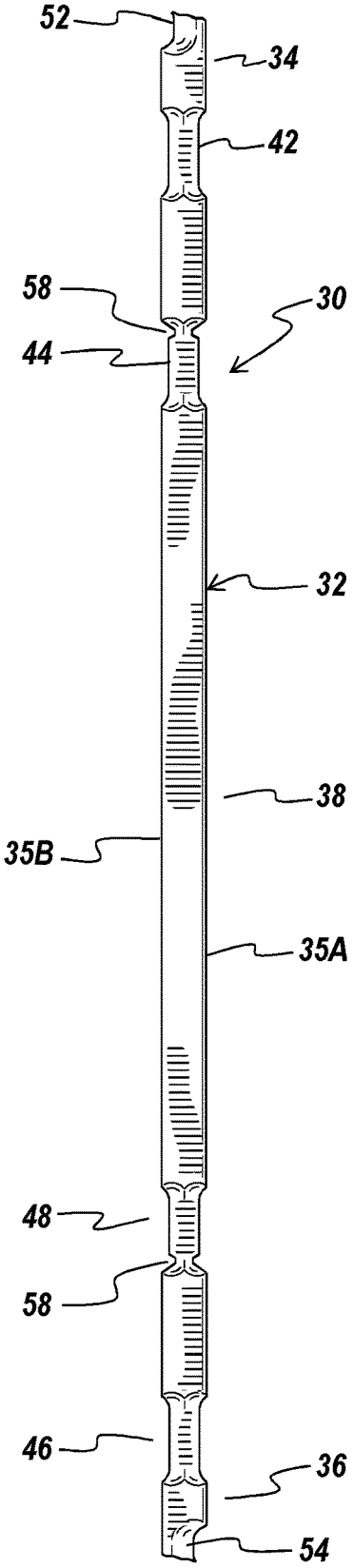
FIG. 1 is a side perspective view of a first embodiment of a tie rod according to the teachings of the present invention.
Figure 2:
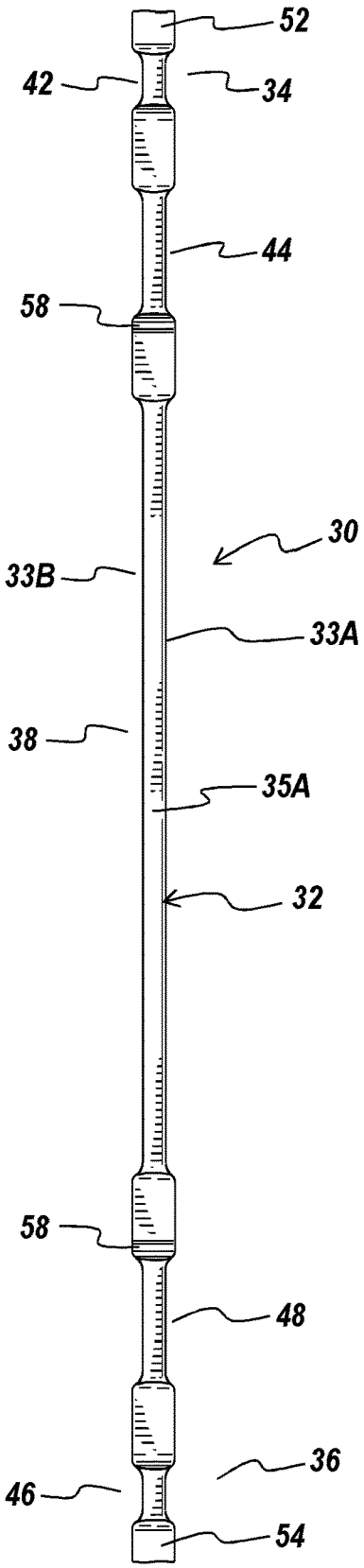
FIG. 2 is a top perspective view of the tie-rod of FIG. 1 according to the teachings of the present invention.
Figure 3:
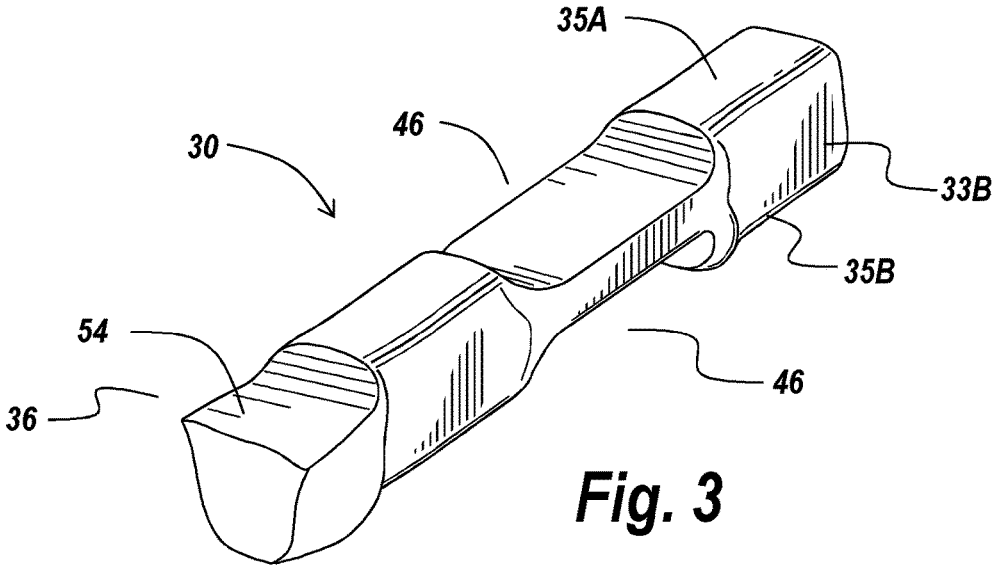
FIG. 3 is a partial view of one end of the tie rod of FIG. 1 according to the teachings of the present invention.
Figure 4:
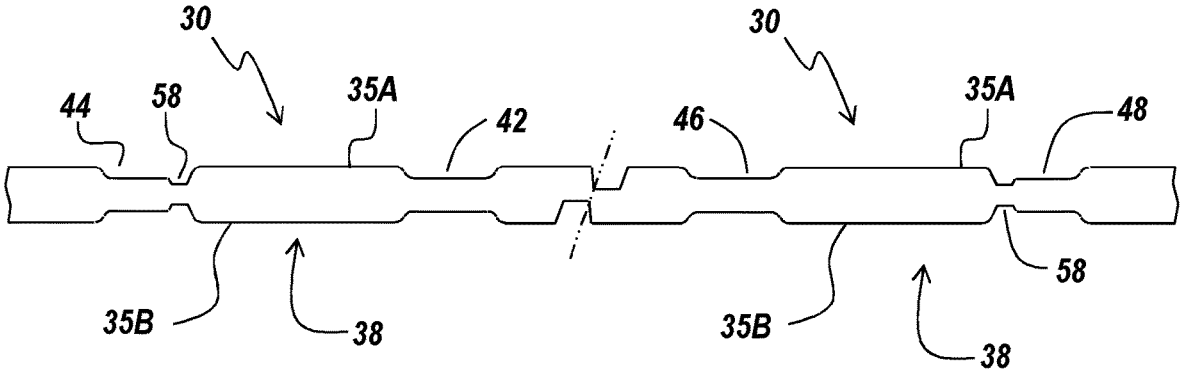
FIG. 4 is a schematic depiction of a pair of tie rods being separated from each other according to the teachings of the present invention.
Figure 5:
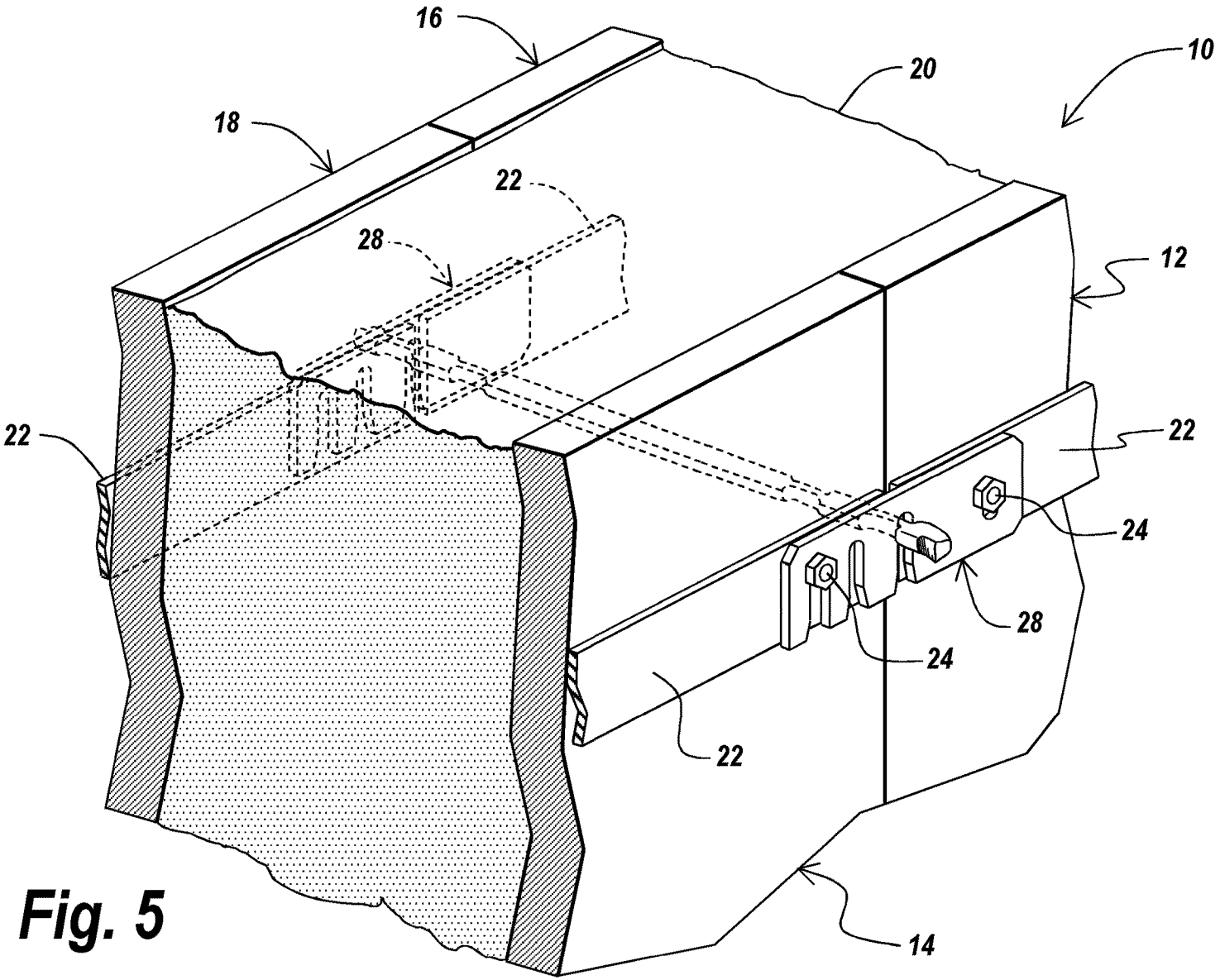
FIG. 5 is a schematic illustration of the tie rods of FIG. 1 mounted between opposed form panels as used in the field according to the teachings of the present invention.

FIG. 5 illustrates a portion of a concrete forming system 10 employing a tie rod of the present invention. The concrete forming system 10 can employ either of the tie rods 30, 110 as described below. The concrete forming system 10 includes a pair of adjacent outer form panels 12, 14 that form an outer wall of a concrete wall to be constructed or formed. A pair of adjacent inner panels 16, 18 are spaced apart from and oppose the outer form panels 12, 14 to form an inner wall of the concrete wall. Those of ordinary skill in the art will readily recognize that the opposed panels form a space or channel therebetween. A concrete mixture can be poured in the channel formed between the inner and outer form walls and allowed to harden or cure into a concrete wall. The concrete wall can form part of a foundation for a suitable structure, such as a house. Those of ordinary skill in the art will readily recognize that any selected number of adjacent forms can be used depending upon the size and overall length of the wall. For the sake of simplicity, only a pair of forms is illustrated. The concrete forms can have any selected shape and are preferably in the shape of a panel. The typical concrete form panel can be composed of plywood with a selected overlay material secured thereto. The panel can have any selected thickness, and preferably has a thickness of about 1.125 inches.

As illustrated, each form panel 12, 14, 16, 18 can have attached thereto one or more panel bars 22. The panel bars have associated therewith a plurality of shoulder bolts 24. For the sake of simplicity, only one shoulder bolt associated with each form panel is shown. A lever or latch mechanism 28 is also provided and is formed on one end of a form panel, such as form panel 12, and has a selected configuration that allows the latch to engage a shoulder bolt 24 formed on the adjacent concrete form 12 as well as to engage the tie rod of the present invention. The concrete forming system 10 can also includes a turnbuckle brace assembly (not shown) for helping to support and if necessary align the concrete forms and/or ensure that the panels are not out of plumb, as is known in the art.

FIGS. 1-4 illustrate a first embodiment of the tie rod 30 according to the teachings of the present invention. The tie rod 30 essentially comprises a relatively flattened main body 32 having a selected length. The body has opposed first and second ends 34 and 36, respectively, that are separated by a central portion 38. The tie rod can be of any selected shape or size and can have any selected length. The tie rod 30 can also be formed of any selected base material, such as carbon steel or stainless steel.

The base material forming the tie rod 30 is placed in and pushed through a series of machines adapted to mechanically manipulate the tie rod. The base material can be in the shape of a wire and can first be pressed in a selected plane or direction to form the flattened main body 32 by known techniques, such as by using rolling mill machine. As a result of the roll milling of the wire material, the resultant flattened device has a main body having a pair of opposed flat sides 33A, 33B and a pair of opposed top and bottom surfaces 35A, 35B.

The relatively flat portion of the main body 32 is then passed through a punch press machine and a top surface 35A of the main body 32 is further flattened, in a different plane, to form a coined region at a selected end. The coined region is also known as a break back region. For example, the punch press machine forms at the first end 34 of the tie rod first and second coined or break back regions 42 and 44, respectively. Similarly, the second end 36 of the tie rod 30 can also be flattened at selected areas to form first and second coined or break back regions 46 and 48, respectively. The first and second coined regions can be separated by any selected distance as is known in the art. The inner coined areas 44 and 48 can have a further notch 58 formed in the coined area.

The tie rod 30 is disposed in a relatively horizontal orientation when mounted between the form panels forming the inner and outer walls. As is known, the panels can have notches (not shown) formed along a side edge that are sized and configured to accept the tie rod 30, thus allowing the tie rod to extend between the adjacent panels. When mounted between opposed panels, the latch 28 is adapted to engage the first or outermost coined regions 42 and 46 formed on the first and second ends 34, 36, respectively. The coined regions function as weakened or break areas of the tie rod 30 that allow the installer the ability to break or snap off the tie rod portion corresponding to the weakened areas during use. For example, the first or outer coined regions 42 and 46 can be snapped off at these areas, if desired, to enable the installer to easily disengage the latch 28. Once the form panels are removed from the cured concrete wall, the portion of the tie rods extending beyond the cured wall can be cleanly snapped off at the second or inner coined regions 44, 48. The notch 58 formed in the inner coined areas assists with the breaking off of that portion of the tie rod.

The first end 34 of the tie rod 30 also has a terminal or outermost end region that terminates in a further coined area or end 52. Similarly, the second end 36 has a terminal or outermost end that terminates in a further coined area or end 54. The coined ends 52, 54 allow the installer to position the tie rod between the panels using know tools and techniques. The coined ends 52 54 are about the same size and are disposed in opposite directions, as shown. Further, the coined area is only formed on one side of the tie rod, and not on both sides of the tie rod, as in the inner coined areas 44, 48 and the outer coined areas 42, 46.

Figure 6:
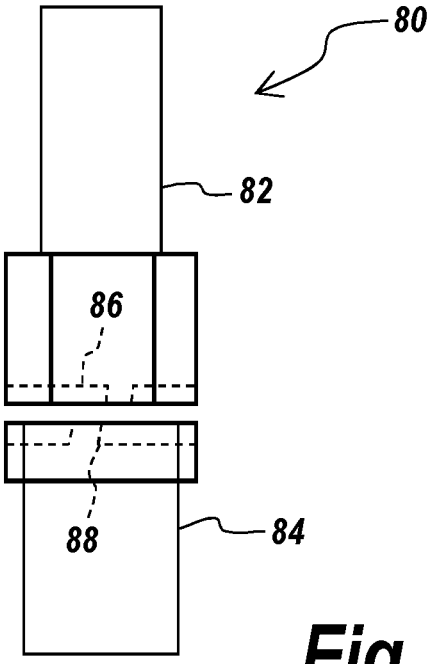
FIGS. 6 and 7 are partial perspective views of the dies used in a punch press machine for separating adjacent tie rods according to the teachings of the present invention.
Figure 7:
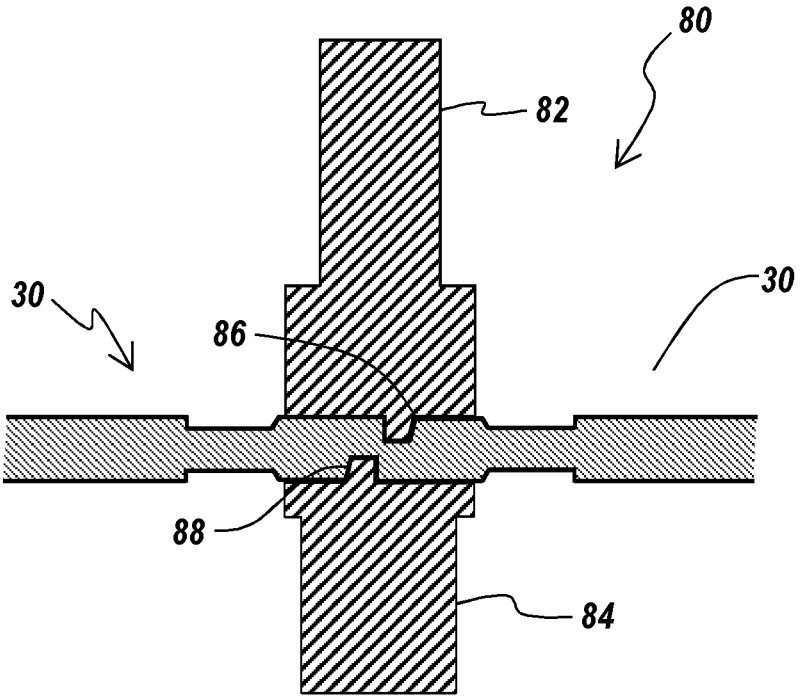
Figure 8:
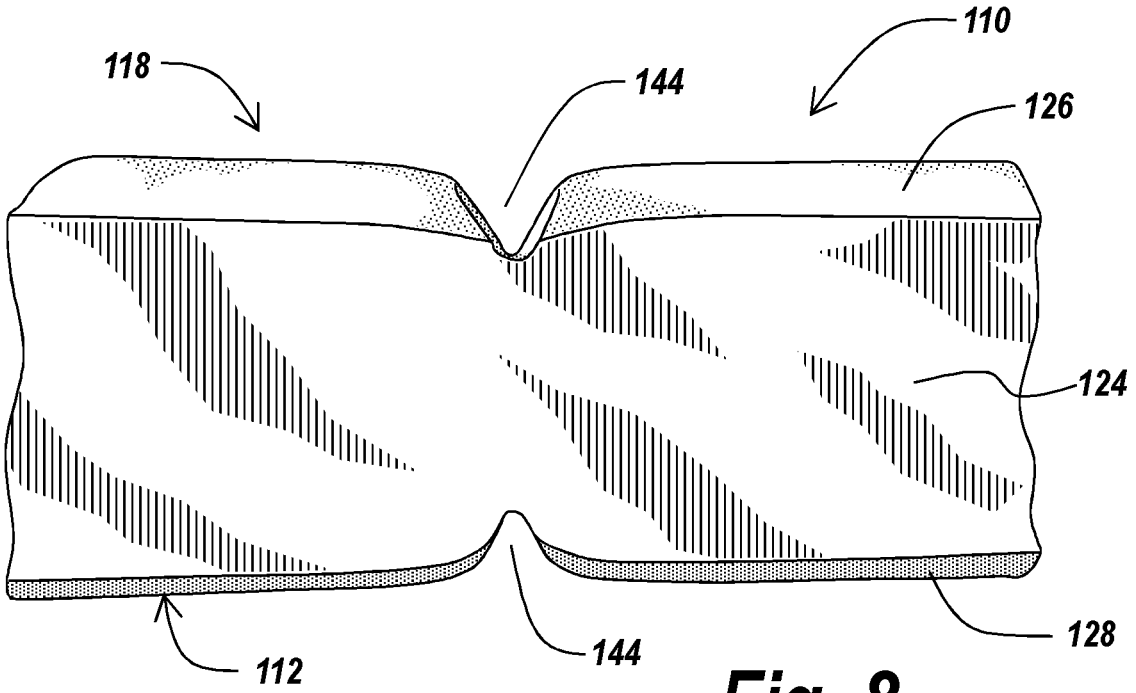
FIG. 8 is a partial perspective view of a second embodiment of a tie rod showing a V-notch according to the teachings of the present invention.
Figure 9:
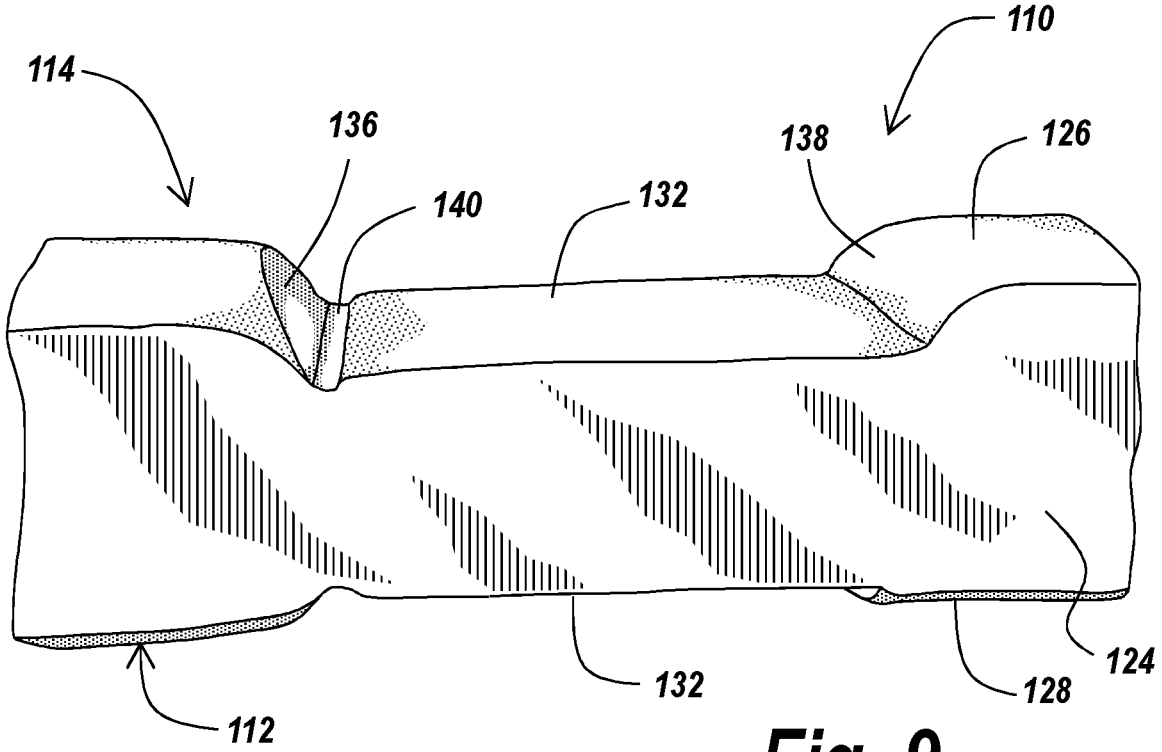
FIG. 9 is a partial perspective view of the tie rod of FIG. 8 showing the coined area according to the teachings of the present invention.
Figure 10:
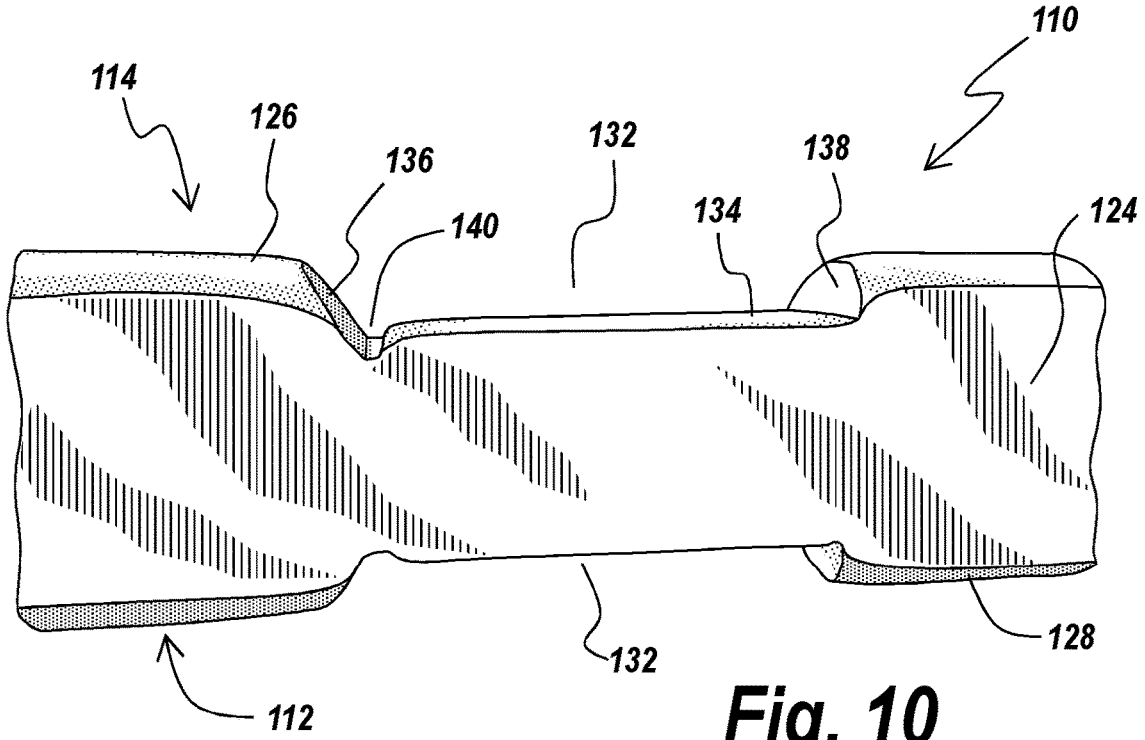
FIG. 10 is a side view of the tie rod of FIG. 8 showing the coined area according to the teachings of the present invention.
Figure 11:
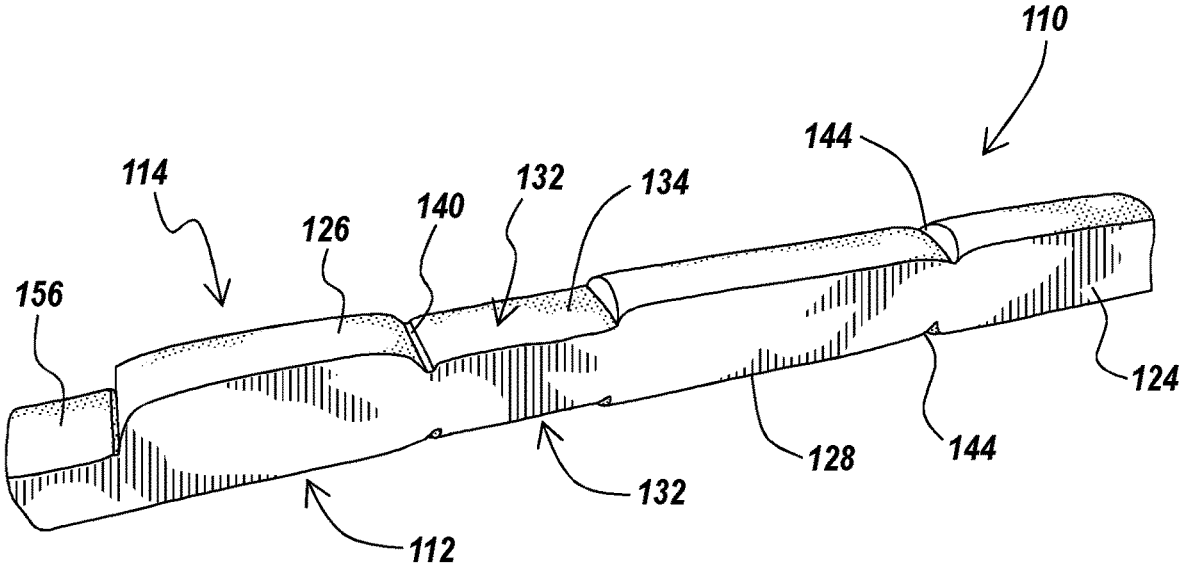
FIGS. 11 and 12 are partial perspective views of the tie rod of FIG. 8 according to the teachings of the present invention.
Figure 12:
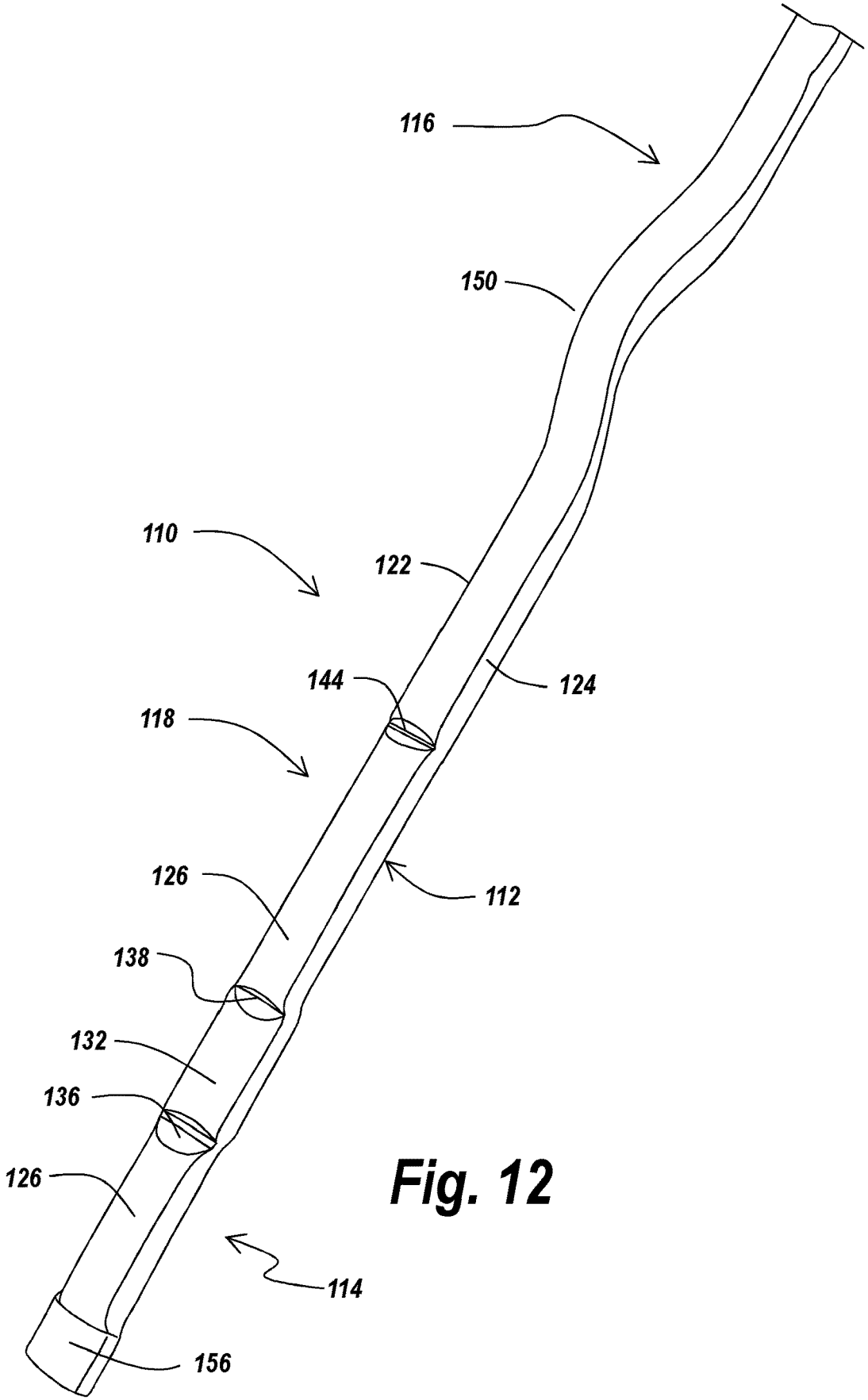
Figure 13:
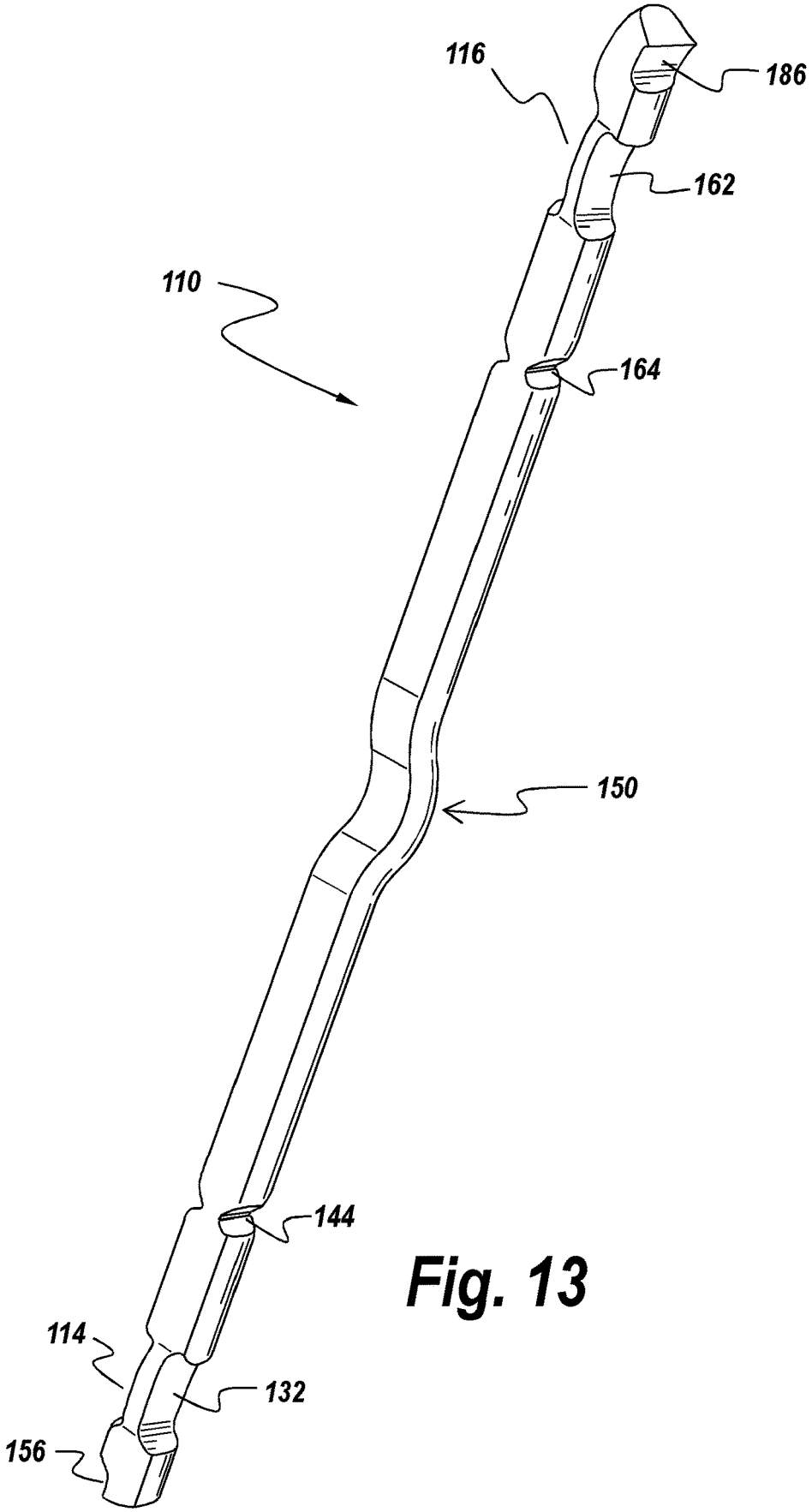
FIG. 13 is a perspective view of the tie rod of FIG. 8 according to the teachings of the present invention.

The coined ends 52 and 54 are formed during the tie rod manufacturing process. For example, a selected die 80 of the punch press machine or of any other type of suitable machine is shown in FIGS. 6 and 7 for ease of illustration. The illustrated die 80 has a pair of opposed dies press portions 82, 84 that can be moved into and out of contact with each other under selected pressure, as is known in the art. Each die press 82, 84 has formed thereon a protruding portion that is adapted to engage the tie rod main body 32. For example, the die press 82 has the protrusion 86 and the die press 84 has the protrusion 88. In order to create separate tie rods, after the tie rod has been rolled and then pressed, the completed tie rod material is passed through the punch press machine. The die 80 employs protrusions 86, 88 that are offset from each other, and when the opposed die presses are pressed together, the protruding portions 86, 88 pinch the main body of the tie rod material so as to snap off the tie rod and to form the coined ends 52, 54. As shown, the coined areas are about equal in size and length, and the coined areas of the adjacent tie rods face in opposite directions.

FIGS. 8-12 illustrate a second embodiment of the tie rod 110 according to the teachings of the present invention. The tie rod 110 also comprises a relatively flattened main body 112 having a selected length. The body has opposed first and second ends 114 and 116, respectively, that is separated by a central portion 118. The tie rod 110 can have any selected shape or size and can have any selected length. The tie rod 110 can also be formed of any selected base material, such as carbon steel or stainless steel.

The tie rod can be flattened according to techniques similar to those described above in connection with the tie rod 30. Once flattened, the main body 112 of the tie rod 110 has a pair of opposed flat sides 122, 124 and a pair of opposed top and bottom surfaces 126, 128. The relatively flat portion of the main body 112 is then further passed through a punch press machine and a top surface 126 of the main body 112 is flattened, in a different plane, to form one or more coined regions at a selected end. The coined regions are also known as break back regions as is known in the art. For example, the punch press machine forms at the first end 114 of the tie rod 110 a coined region 132 that is formed in the top and bottom surfaces of the main body. The coined region 132 has a relatively flat bottom surface 134 and a pair of opposed side walls 136, 138. The coined region 132 is further machined according to known techniques to form a notch 140 therein. For example, the punch press die can have a protrusion formed thereon that forms the notch 140 while simultaneously forming the coined area 132. The notch 140 has a bottom portion that extends into the coined region and terminates below the surface of the bottom surface 134. That is, the notch 140 extends deeper into the main body 112 of the tie rod 110 than the coined region 132. The notch 144 enables an installer to more easily break or snap off the first end 114 of the tie rod.

The tie rod 110 is further machined to form a second notch 144 on the top and bottom surfaces 126, 128 of the tie rod. The notch 144 is formed in the central portion 118 of the main body inwardly of the coined area 132. The coined region 132 and the notch 144 can be separated by any selected distance as is known in the art. Similarly, the second end 116 of the tie rod 110 can also be flattened to form the coined region 162. The coined region has a structure similar to the coined region 162 and also includes a further notch.

The main body 112 of the tie rod 110 also has a bend region 150 formed therein. The bend region 150 is formed in the main body at a position closer to the second end 116 than the first end 114 of the tie rod 110. The bend region forms an area of the main body that is offset from the lateral axis of the remainder of the main body. The bend region 150 ensures that the tie rod stays affixed within the concrete wall after installation.

The first end 114 of the tie rod 110 also has a terminal or outermost end region that terminates in a further coined end 156. Similarly, the second end 116 has a terminal or outermost end that terminates in a further coined end 186. The coined ends 156, 186 allow the installer to position the tie rod between the panels using known tools and techniques. The coined ends 156, 186 are about the same size and are disposed or face in opposite directions, as shown. Further, each coined area is only formed on one side of the tie rod, and not on both sides of the tie rod.

The coined ends 156 and 186 are formed during the tie rod manufacturing process. For example, similar to the tie rod 30, the die 80 of the press forming machine or of a different machine is shown in FIGS. 6 and 7 for ease of illustration. In order to create separate tie rods, a length of tie rod material is passed through the die press forming machine. The die 80 employs the offset key portions 86, 88, and when the opposed die presses are pressed together, the protruding key portions 86, 88 pinch the main body of the tie rod material so as to snap off the tie rod and to form the coined ends 156, 186.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

We claim:

1. A method of forming a tie rod, comprising:

flattening a main body of a wire formed of a selected material in a first selected plane to form a flattened main body, further flattening selected portions of the flattened main body in a second plane perpendicular to the first plane to form one or more break back regions, and passing the wire through a punch press machine including a first die having a first protrusion and first immediately adjacent flat extended coining region, and a second die having a second protrusion and a second immediately adjacent flat extended coining region; wherein the first die and second die oppose each other, and the first and second coining regions and opposing surfaces of the first and second protrusions are parallel to each other, and wherein the first and the second protrusions and the first and second coining regions are offset from each other in a direction of wire travel to form one or more flattened coined regions in one or more ends of the wire and to sever the wire;

moving the first and second opposing dies towards each other such that the first and second protrusions contact the wire to crimp and cut the wire, and simultaneously pressing the wire between the first and second flat extended coining regions to stamp and press the wire to form the flattened coined regions thus forming the tie rod, wherein the flattened coined regions are axially spaced apart from the crimped and cut region of the wire.

2. The method of claim 1, wherein the step of moving further comprises pressing the dies into and out of contact with each other under a selected amount of pressure.

3. The method of claim 2, wherein the step of pressing further comprises forming a first coined region facing in a first direction in a first end of the first tie rod, and forming a second coined region facing in a second direction in a second end of the second tie rod, wherein the first and second directions are opposed relative to each other, and wherein the first end of the first tie rod and the second end of the second tie rod are adjacent to each other during formation.

4. The method of claim 1, wherein the wire is formed from carbon steel or stainless steel.

5. The method of claim 1, wherein the main body has an intermediate portion disposed between first and second end portions, and further comprising forming a bent portion in the intermediate portion of the main body.

6. The method of claim 1, wherein the break back regions are formed on a first surface of the flattened main body, further comprising forming a plurality of notches in a second surface opposite the first surface.

7. The method of claim 6, further comprising forming a plurality of first notches in the first surface.

8. The method of claim 7, further comprising forming a plurality of second notches in the first surface, wherein each of the plurality of second notches is formed immediately adjacent to each of the break back regions, and wherein each of the second notches has a depth that extends into the first surface of the main body that is larger than the depth into the first surface of the break back regions.

* * * * *